United States Patent [19]

Singer

[11] 4,275,757

[45] Jun. 30, 1981

[54] MANHOLE STRUCTURE AND METHOD OF MAKING SAME

[76] Inventor: Frederic J. Singer, 715 S. Nakoma Dr., Santa Ana, Calif. 92704

[21] Appl. No.: 63,996

[22] Filed: Aug. 6, 1979

[51] Int. Cl.[3] ..... E02D 29/12

[52] U.S. Cl. ..... 137/363; 52/20

[58] Field of Search ..... 52/20; 137/363

[56] References Cited

U.S. PATENT DOCUMENTS

| | | | |
|---|---|---|---|
| Re. 29,636 | 5/1978 | Gilbu | 52/20 |
| 3,715,958 | 2/1973 | Crawford et al. | 137/363 X |
| 3,745,738 | 7/1973 | Singer | 52/20 X |
| 4,089,139 | 5/1978 | Moffa et al. | 52/20 |

*Primary Examiner*—Gerald A. Michalsky

*Attorney, Agent, or Firm*—William C. Babcock

[57] ABSTRACT

A multipiece prefabricated manhole assembly and method of making same. The manhole assembly is formed from a cured mixture of a polyester and fiberglass that may have the components thereof wholly or partially assembled in the field to rest on a manhole foundation to provide a manhole structure that is dimensionally stable and one that is substantially impervious to the corrosive action of sewage and gases emanating from the latter such as hydrogen sulphide, methane and the like.

17 Claims, 17 Drawing Figures

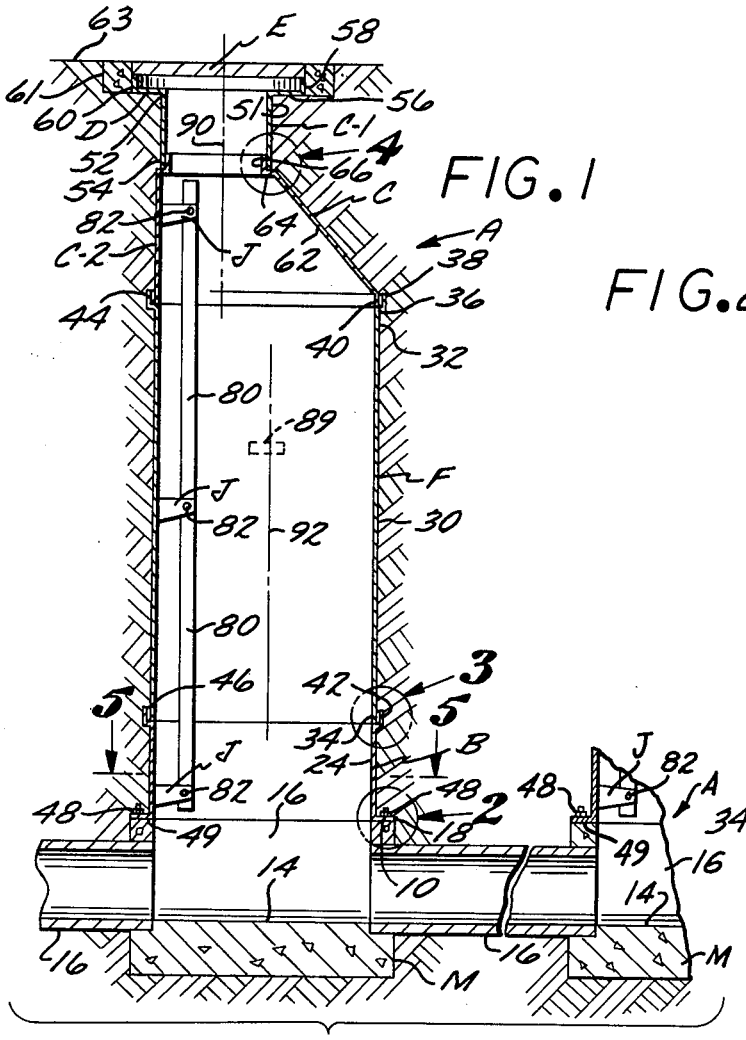
FIG. 1
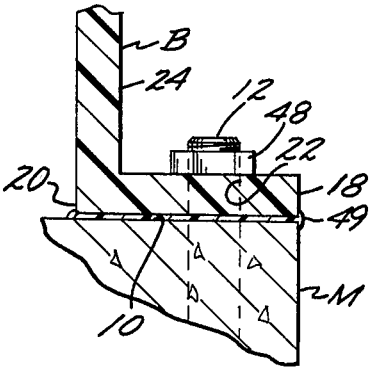
FIG. 2
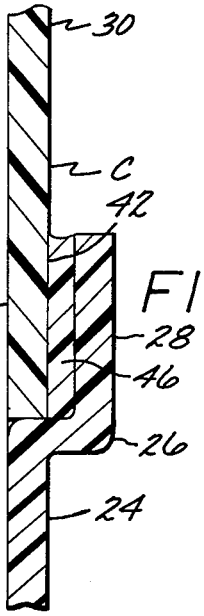
FIG. 3
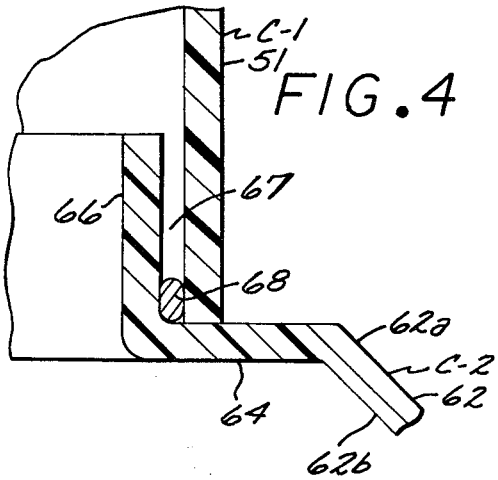
FIG. 4
FIG. 5
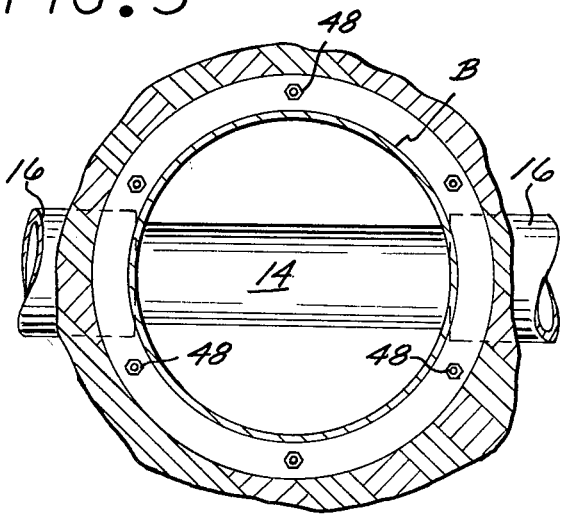

FIG. 14
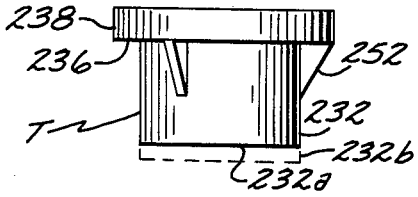
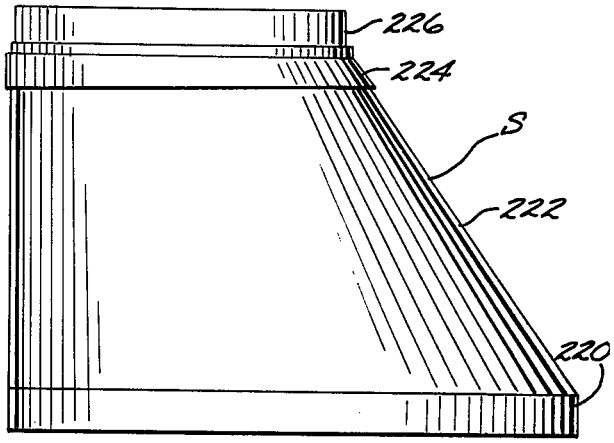
FIG. 15
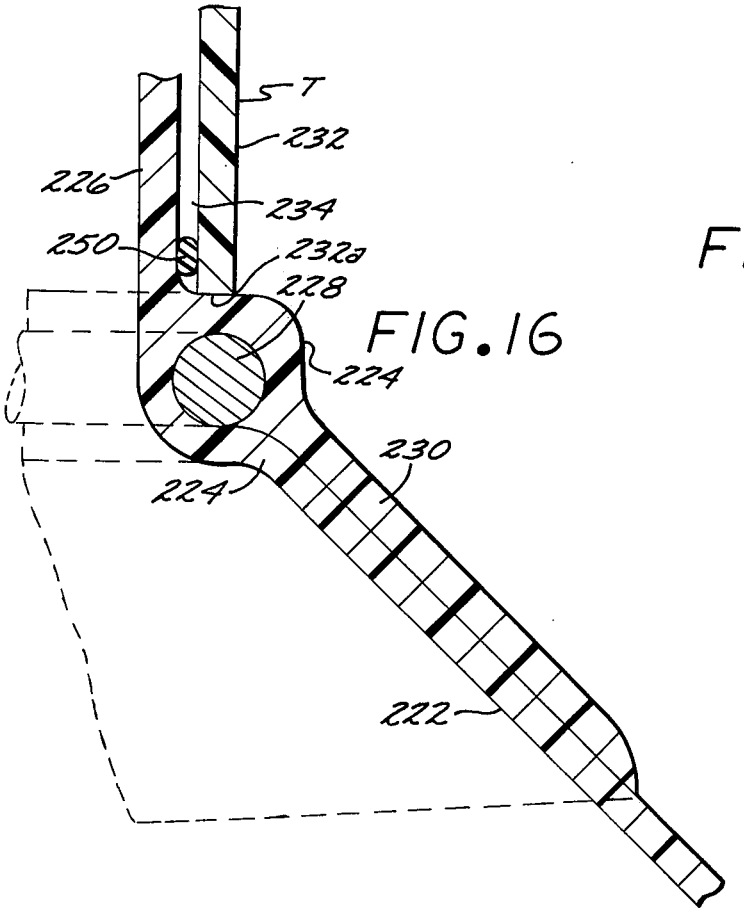
FIG. 16
FIG. 17
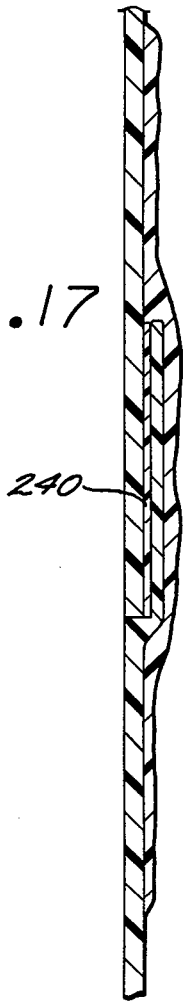

MANHOLE STRUCTURE AND METHOD OF MAKING SAME

CROSS-REFERENCE TO RELATED APPLICATION

The present application discloses and claims a manhole structure that is an improvement over the "Corrosion Resistant Manhole Shaft and Method of Making Same" disclosed and claimed in my U.S. Pat. No. 3,745,738 that issued on July 7, 1973.

BACKGROUND OF THE INVENTION

1. Field of the Invention

Manhole structure and method of making same.

2. Description of the Prior Art

In the past, manhole shafts for sewer lines have commonly been made from brick or concrete. Such shafts have the operational disadvantage that hydrogen sulphide that emanates from the sewage combines with moisture to provide an acidic liquid that attacks both concrete and mortar between bricks to cause the disintegration thereof, and as a result the manhole shafts being subject to substantial maintenance work to maintain them in a usable condition. Such rigid shafts also are subject to cracking during earthquakes, whereas fiberglass shafts, having tremendous flexural strength, are likely to only deform slightly without damage to them.

To minimize the above-mentioned operational disadvantages, manhole shafts have been lined with polymerized sheet lining that are substantially inert to the action of hydrogen sulphide and other gases emanating from sewage such as described and claimed in my previously issued U.S. Pat. No. 3,745,738. The lining of manhole shafts with polymerized sheets has not been completely successful, as it is not only expensive, but the lining invariably develops minute cracks and imperfections therein through which hydrogen sulphide and water migrate to form an acidic liquid that attacks the concrete and mortar that envelops the polymerized sheet liner.

A major object of the present invention is to minimize the cost of manhole structures, the time and physical effort involved in forming and constructing the same, as well as providing a manhole structure that is substantially impervious to the action of sewer gases and hence requires a minimum of maintenance attention and will not be damaged during earthquakes.

Another object of the invention is to supply a manhole structure that is formed from a number of separate prefabricated components that are corrosion resistant and may be delivered to the job site either wholly or partially assembled, and the components when in engaging relationship and resting on a manhole foundation providing a dimensionally stable manhole structure that is resistant to top and side loading, and all corrosive agents found in waste water collection systems.

Yet another object of the invention is to furnish a number of components that may be stacked one above the other and bonded together to define a vertically extending confined space above a manhole foundation, with each of the components including an interiorly positioned ladder section, and the ladder sections capable of being vertically aligned and spliced together to provide a ladder by which a workman may enter the interior of the manhole structure for inspection or maintenance purposes.

SUMMARY OF THE INVENTION

The present invention is a multipiece corrosion resistant manhole structure assembly that may be wholly or partially assembled in the field to define a dimensionally stable manhole structure that rests on a manhole foundation located at the bottom of an excavation. Each manhole structure when assembled extends upwardly from the manhole foundation on which it is mounted to communicate with a traffic ring and cover removably supported on the ladder, with the cover being at street grade.

The foundation includes an upper horizontal surface from which a number of circumferentially spaced stud bolts extend upwardly. The manhole structure assembly includes a base section that has a ring-shaped first flange that has an inner periphery and a number of circumferentially spaced openings therein through which the stud bolts can extend upwardly when the first flange rests on the horizontal surface of the foundation. A cylindrical first wall extends upwardly from the inner periphery of the flange to develop into a circular outwardly extending first body shoulder, and a second cylindrical wall that extends upwardly from the outer extremity of the body shoulder. The second cylindrical wall is of substantially less height than the first cylindrical wall.

A top assembly is provided that extends downwardly from the traffic ring and cover, with the top assembly including a cylindrical wall member on the lower extremity thereof. The invention also includes a riser in the form of a cylindrical shell that has an upper portion and a lower portion, with the upper portion including an outwardly extending second body shoulder that has a cylindrical wall piece extending upwardly from the outer extremity thereof. The cylindrical wall member of the top assembly rests on the second body shoulder and cooperates with the cylindrical wall piece to define a first annulus space therebetween. The lower portion of the riser rests on the first body shoulder and cooperates with the second cylindrical wall to define a second annulus space therebetween. The first annulus shaped space is sealed by a transversely compressed resilient ring disposed therein. The second annulus shaped space has epoxy cement or the like contained therein for bonding the riser to the base in a water-tight manner. A suitable bonding and sealing agent covers the horizontal surface of the foundation and effects a fluid-tight seal between the first flange and the horizontal surface, and the flange being held in a fixed position on the foundation by nuts that engage the stud bolts that extend upwardly through the openings in the first flange.

The base, riser and top assembly are formed as second components from a cured mixture of a polyester fiber glass or other corrosion-proof as a part thereof, with the base being first mounted on the foundation and the riser and secured thereto, or if desired, the base and riser may be bonded together and lowered into the excavation for the first flange of the base to rest on the horizontal surface of the foundation. The top assembly is then set onto the upper portion of the riser. Both the length of the riser and that of the top assembly may be trimmed for the overall height of the manhole structure to be such that it terminates a desired distance below the street surface and communicates with the traffic ring and cover. The interior surfaces of the base, riser and top assembly are covered with a gel coat of corrosion resistant polymerized resin that is impervious to such corrosive gases as hydrogen sulphides, sewer gas and the like.

BRIEF DESCRIPTION OF THE DRAWINGS

FIG. 1 is a longitudinal cross-sectional view of the components of the invention arranged to define a dimensionally stable first form of manhole structure that rests on an upper horizontal surface of a manhole foundation;

FIG. 2 is a fragmentary vertical cross-sectional view of the lower portion of the base mounted on the manhole foundation as shown within the phantom line identified by the numeral 2 in FIG. 1;

FIG. 3 is a fragmentary vertical cross-sectional view of the interlocking portion of the base and riser taken within the phantom line shown in FIG. 1 that is identified by the numeral 3;

FIG. 4 is a fragmentary vertical cross-sectional view of a portion of the top assembly situated within the phantom line illustrated in FIG. 1 and identified by the numeral 4;

FIG. 5 is a transverse cross-sectional view of the first form of manhole structure taken on the line 5—5 of FIG. 1;

FIG. 14 is a side elevational view of the top section used in the fourth form of manhole structure;

FIG. 15 is a side elevational view of the manhole structure situated below the top section in the fourth form of manhole structure;

FIG. 16 is a fragmentary vertical cross-sectional view of the manhole structure taken within the circle shown in phantom line in FIG. 12 that is identified by the numeral 15; and FIG. 17 is a fragmentary vertical cross-sectional view of the manhole structure taken on the line 17—17 of FIG. 12.

DESCRIPTION OF THE PREFERRED EMBODIMENTS

Figure 6:
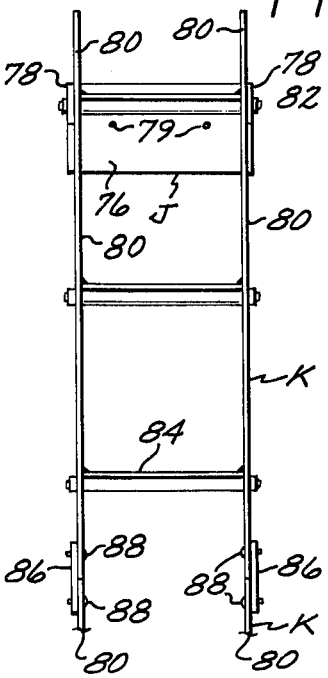
FIG. 6 is a front elevational view of a section of ladder that is spliced to a ladder section situated therebelow, and the ladder being secured to the interior surface of the base riser and top assembly.

The first form A of a multipiece manhole assembly in which the components are prefabricated and are at least partially combined at a job site to define an integral manhole structure that extends upwardly from a flat horizontal surface 10 of a manhole foundation M as illustrated in FIG. 1. The foundation M is located at the bottom of a trench or excavation (not shown). The components of the manhole assembly A are formed from a cured mixture of polyester resin and fiberglass, and possess sufficient strength to withstand a maximum vertical and side loading to which the first form A of manhole structure will be subjected when the trench or excavation is backfilled with earth.

A number of circumferentially and equally spaced stud bolts 12 are partially embedded in foundation M and project upwardly above the flat horizontal surface 10 a substantial distance. The foundation M has an open passage 14 extending across the upper portion thereof, which passage is in communication with the ends of pipe 16 that extend to others of the foundation M that form in part of a sewer system with each foundation M supporting one of the manhole assemblies. The circumferential and diametrical spacing of the stud bolts 12 is preferably determined by a template (not shown).

The manhole assembly A illustrated in FIG. 1 has a base B that has a circular ring-shaped flange 18 that has an inner periphery 20 with the flange having a number of circumferentially and diametrically spaced bolt holes 22 therein, that conform to the spacing of the stud bolts 12 previously mentioned. A cylindrical first wall 24 extends upwardly from the inner periphery 20 to develop at the upper portion thereof into a first circumferentially and outwardly extending body shoulder 26 as shown in FIG. 3, which body shoulder has a second cylindrical side wall 28 projecting upwardly from the outer periphery thereof. The second cylindrical wall 28 is of substantially less height than the first cylindrical wall 24. The manhole assembly A shown in FIG. 1 is illustrated as being connected by pipe 16 to a second foundation M that supports one of the manhole assemblies A.

The first form of manhole structure A includes a top assembly C best seen in FIG. 1 that includes an upper portion C-1 and lower portion C-2, with the lower portion C-2 having a cylindrical wall member 29 projecting downwardly from the lower portion thereof. The top assembly C has a traffic ring D and cover E removably supported by the upper portion C-1, with the upper extremities of the traffic ring and cover being street grade as shown in FIG. 1. The first form A of the manhole structure as shown in FIG. 1 includes an elongate substantially vertically disposed riser F in the form of a cylindrical shell 30 that has an upper portion 32 and lower portion 34. The upper portion 32 has a second circular body shoulder 36 extending outwardly therefrom with the body shoulder on the outer extremity developing into an upwardly extending cylindrical wall piece 38. The interior diameter of the cylindrical wall piece 38 is larger than that of the external diameter of the cylindrical wall member 29, and as a result when the wall member is lowered into a position to rest on the second body shoulder 36, the wall member and cylindrical wall piece 38 define a first annulus shaped space 40 therebetween. A transversely compressed resilient ring 44, such as the ring 68 shown in FIG. 4, is disposed in the annulus shaped space 40 and serves to seal the top assembly C to the upper end portion of the riser F. The interior diameter of the second wall 28 as may be seen in FIGS. 1 and 3 is greater than the external diameter of the lower end portion 34 of the riser F and as a result a second annulus-shaped space 42 is provided therebetween when the lowre portion 34 rests on the first body shoulder 26.

The second annulus-shaped space 42 is filled with a sealing means 46 such as an epoxy cement or the like, which welds the lower end of the riser S to the base B. In FIG. 2 it will be noted that the flat surface 10 of foundation M is coated with a film 49 of an epoxy cement or like bonding and sealing agent that is engaged and contacted by the lower surface of first flange 18 when the latter is disposed on foundation M for the stud bolts 12 to project upwardly through the circumferentially spaced bolt holes 22 in the flange.

The top C as best seen in FIGS. 1 and 4 includes an upper portion C-1 that has a cylindrical wall 51 that has an upper section 52 and lower section 54. A second ring-shaped flange 56 projects outwardly from the upper section 52 and develops on the outer periphery thereof into an upwardly extending cylindrical rib 58 of relatively short height. The flange 56 and the cylindrical rib 58 cooperate to define a confined space 60 in which the traffic ring D and cover E are disposed. A concrete ring 61 extends around the traffic ring and cover E as shown in FIG. 1, with the upper surface of the concrete ring being flush with the road surface 63.

The top C as may best be seen in FIG. 1 also includes a lower top portion C-2 that includes an inwardly tapering wall of generally circular transverse cross-section, which wall 62 on the upper portion thereof develops into an inwardly extending body shoulder 64 that has a lip of cylindrical shape 66 extending upwardly from the inner periphery thereof. The interior surface of the cylindrical wall 51 is of greater diameter than the external diameter of the lip 66 and is separated from the latter by an annulus space 67 in which a resilient ring 68 is disposed.

Figure 8:
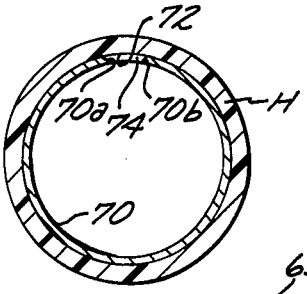
FIG. 8 is a transverse cross-sectional view of the form utilized in fabricating the components of the manhole structure assembly and illustrating the releasable form on which a mixture of polyester resin and fiberglass is sprayed or otherwise dispensed.
Figure 9:
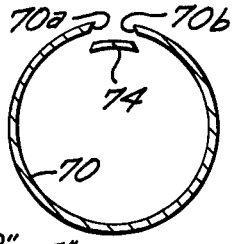
FIG. 9 is a transverse cross-sectional view of the form shown in FIG. 8.

The manhole structure components above-identified are formed from a mixture of a polyester resin and fiberglass, which mixture is sprayed, blown or otherwise applied to the exterior surface of the form G shown in FIG. 8, which form is defined by resilient shell 70 of circular transverse cross section and that conforms longitudinally to the interior surface of the particular component that is to be made. The shell 70 as may be seen in FIG. 9 has two spaced tapered end surfaces 70*a* and 70*b* that extend the longitudinal distance thereof and define a space 72 therebetween. An insert 74 is removably supported in opening 72 during the time period the mixture H of fiberglass and resin is being applied to the exterior surface of form G. Insert 74 has upwardly and inwardly tapering end surface that removably abut against the longitudinal tapered end surfaces 70*a* and 70*b*. Prior to the mixture H being applied to the exterior surface of the form a film of a release agent (not shown) is applied to the exterior surface. After the mixture H has set after being applied to the form G, the insert is removed, which allows the end surfaces 70*a* and 70*b* to be moved towards one another, and the exterior surface of the form G separated from the interior surface of the molded component to the extent the component may be slid longitudinally from the form.

After the components are formed as above-described they may be transported to the job site and assembled one above the other into structure A as shown in FIG. 1.

Alternately, the base B may have the riser F secured thereto prior to being shipped to the job site.

The riser F as may be seen in FIG. 1 has a pair of lifting eyes 89 disposed on opposite sides thereof. The first form of manhole structure A, as shown in FIG. 1, is assembled into an integral structure, by the base B being mounted on the manhole foundation M as shown in FIG. 1 with the bolts 12 extending upwardly through the spaced bolt holes 22 in the flange 18, and the bolts being engaged by nuts 48. The flange 18 is also secured to the horizontal surface 10 of the foundation M by a layer of epoxy cement 49 as shown in FIG. 2. After the base B is so secured to the foundation M, the riser F may be lowered downwardly thereon for the lower portion 34 to be situated within the second cylindrical wall 28 as shown in FIG. 3 and with sealing means 46 in the form of epoxy cement or the like bonding the lower portion 34 to the second cylindrical wall 28, as shown in FIG. 3. As an alternate to this procedure, the base B may be permanently secured to the lower portion of the riser F at the site of manufacture, and the base and riser lowered as an integral unit onto the foundation M to be secured thereto by the nuts 48 that engage bolts 12. The top portion C-1 and the riser F may normally be fabricated to a length greater than that required at the job site, with surplus material being severed from the lower portion of the top portion C-1 and riser F to provide an overall height for the manhole structure A so that the cover E when supported on the traffic ring D is substantially flush with the street surface 63, and with the concrete ring 61 extending around the cylindrical rib 58.

Figure 7:
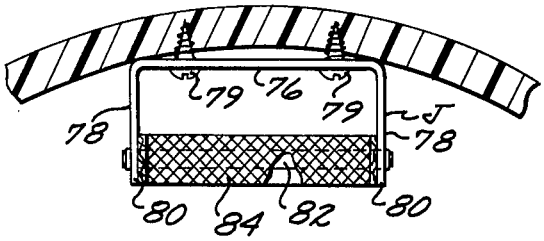
FIG. 7 is a fragmentary transverse cross-sectional view of a bracket supported ladder secured to the interior surface of the riser.

A number of brackets J are provided as shown in FIGS. 6 and 7, each of which includes an elongate web 76 that has a pair of legs 78 projecting outwardly from the ends thereof. Each pair of legs is in abutting contact with a pair of vertically laterally spaced members 80 that have transverse bores therein that are aligned with transverse bores in the web (not shown). A number of rungs 82 are provided that extend through the axially aligned bores in the legs 78 and members 80 and extend outwardly from the members. A number of tubular treads 84 are also provided, with each rung having a tubular thread 84 mounted thereon, and each tread being situated between the pair of members 80. The brackets J, and the members 80, rungs 82 and treads 84 are preferably formed from a fiberglass reinforced polyester or other resin that resists the action of hydrogen sulphide and other sewer gases. The elements above-named when bonded together with an epoxy cement cooperate to provide a ladder K, as shown in FIG. 6, that extends the longitudinal height of the interior of the first form of manhole assembly A when the ladder is assembled as shown in FIG. 1. The base B, riser F, and top C preferably have sections of the ladder K secured to the interior surface thereof prior to them being assembled into the manhole structure as illustrated in FIG. 1, and at the time of assembly these ladder sections are vertically aligned with one another. The ladder sections are joined to one another by splice plates 86 that overlap upper and lower portions of ladder assemblies K and are joined to the overlapped ladder sections by bolts 88 or other suitable fastening means. The plates 86 are also epoxy bonded to the ladder members 80. In the first form of the manhole structure A shown in FIG. 1 it will be seen that the vertical center line 90 of the top C is laterally offset from the vertical center line 92 of the riser F and base B.

Figure 10:
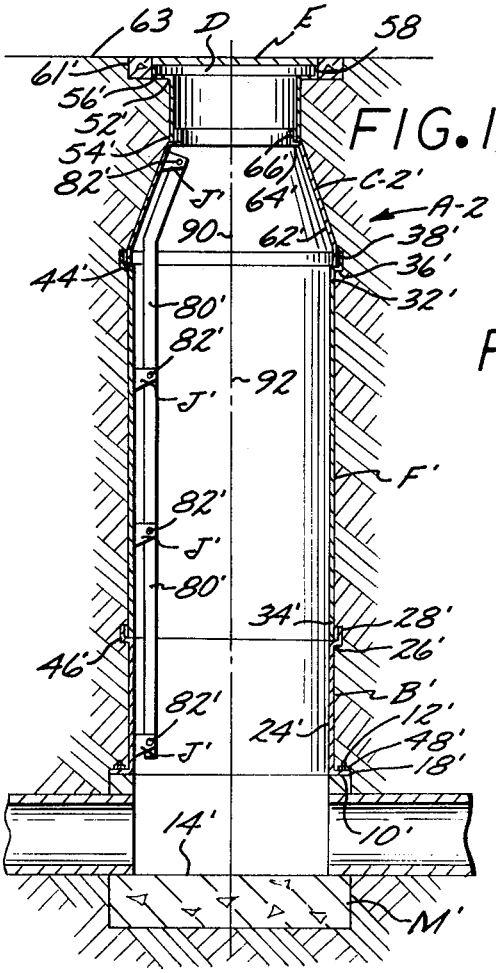
FIG. 10 is a longitudinal cross-sectional view of a second form of the manhole structure assembly.

A second form A-2 of the manhole structure is shown in FIG. 10 that is identical with the first form A other than that the lower top section C-2 is of such shape that the centerline 90 of the top section C is axially aligned with the vertical center line 92 that extends downwardly through the riser F and base B. The second form A-2 of the manhole structure is assembled in the same manner as the first form A, is of the same materials, and serves the same function and provides the same advantages as the first form of manhole structure A Elements of the second form A-2 that are the same as that of the form A previously described are identified by the same numerals previously used, but with primes being added thereto as shown in FIG. 10.

Figure 11:
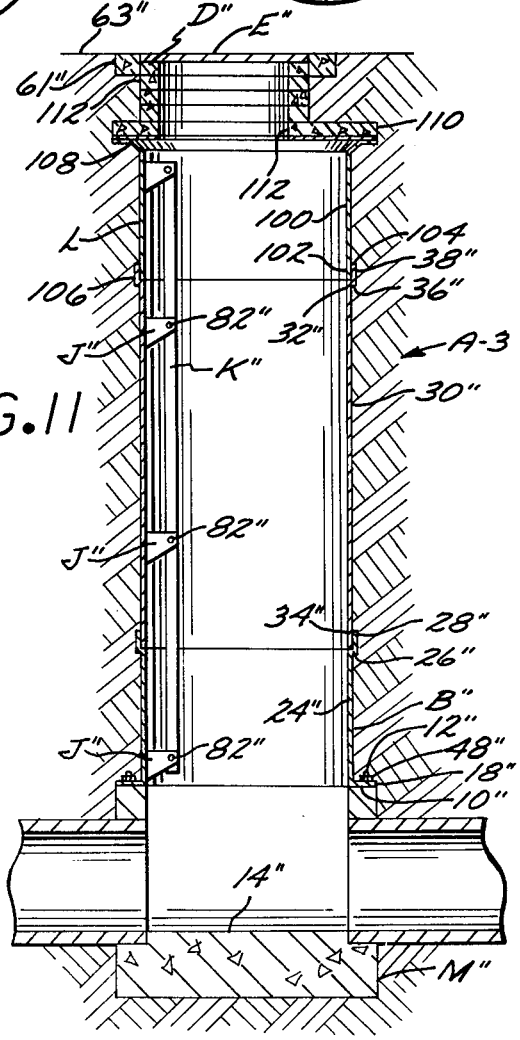
FIG. 11 is a third form of the manhole structure assembly resting on a manhole foundation, and with earth being backfilled into the excavation that has the manhole foundation situated at the bottom thereof.

A third form of the manhole structure A-3 is shown in FIG. 11 that utilizes the same manhole foundation M", base B", and riser F" as the first manhole structure A. Elements in the third form of manhole structure A-3 that are common to the first form A are identified by the same numerals and letters previously used but with double primes being added thereto. A top assembly L is provided in the third form of manhole structure A-3 that includes a cylindrical shell 100 that has a lower end portion 102 that rests on body shoulder 36", and an angular space 104 between end portion 102 and cylindrical wall piece 38" being removably sealed with a resilient ring 106. The upper end of the shell 100 develops into a circular outwardly extending flange 108. The flange 108 supports a concrete circular plate 110 that has an off-centered opening 112 therein that is adjacently disposed to the ladder K" that extends downwardly in the third form of manhole structure A-3. A number of concrete rings 112 are stacked one above the other on the plate 110, and are bonded together with a commercially available sealant (not shown). The concrete rings 112 are stacked to such height that when a traffic ring D and cover E are supported thereon, the cover is substantially flush with the street surface 63. The upwardly disposed one of the concrete rings 112, traffic ring D, and cover E are surrounded by a larger concrete ring 61".

A fourth form P of the manhole structure is shown in FIGS. 12 to 17 that, with the exception of the top T thereof, is delivered to the job site as an integral unit. The fourth form P of the manhole structure like the three forms previously described is defined by a glass reinforced polyester 199 that preferably has a compressive strength of at least 25 K p.s.i., a tensile strength of at least 18 K p.s.i., and a shear strength of at least 1.27 K p.s.i. The fourth form P of manhole structure as well as those previously described preferably should take a 30 p.s.i. back pressure without crazing, cracking or wicking. The glass reinforced polyester 199 should be impervious to sewer gases, non-conductive to bacterial and fungi growth, and completely resistant to all strong acids, alkalis and contaminants normally found in sewage, as well as oils, greases, vegatable and animal oils, fats and soap.

Figure 12:
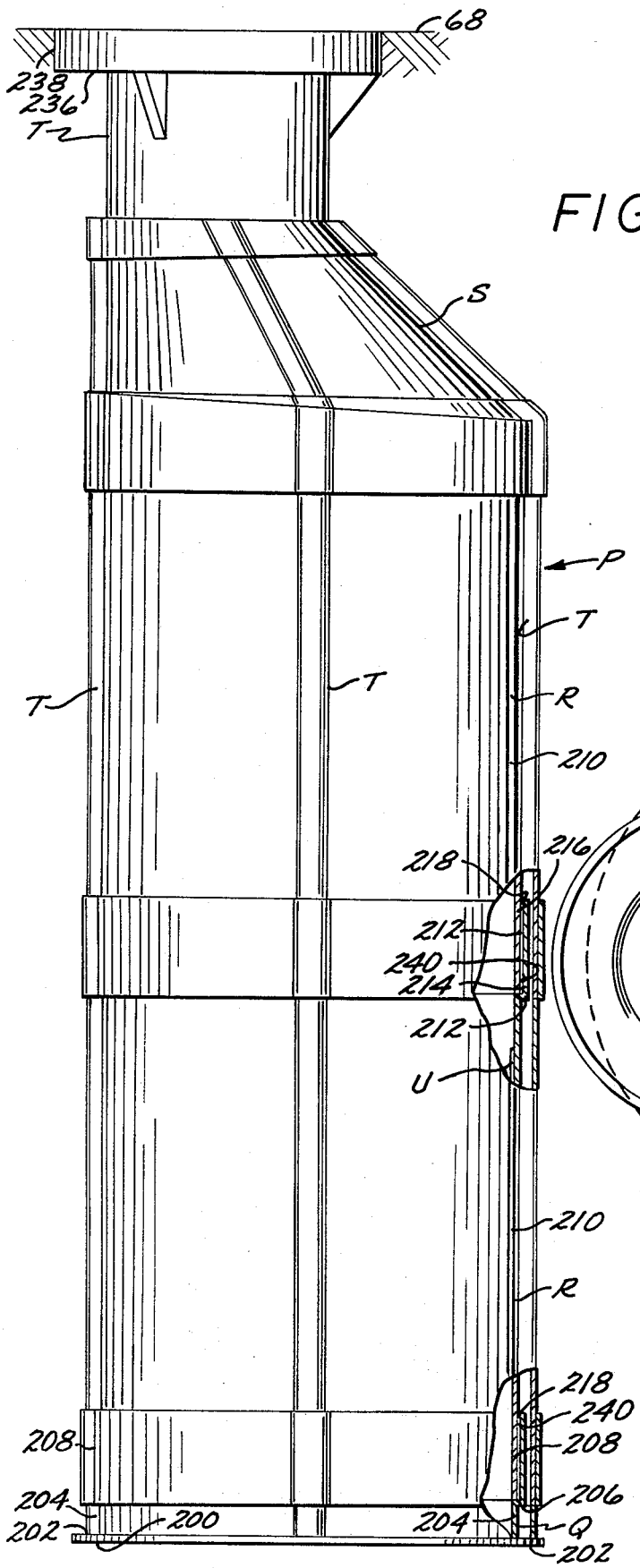
FIG. 12 is a side elevational view of a fourth form of manhole structure that is prefabricated as an integral unit and is delivered as such to a job site to be mounted on a foundation.
Figure 13:
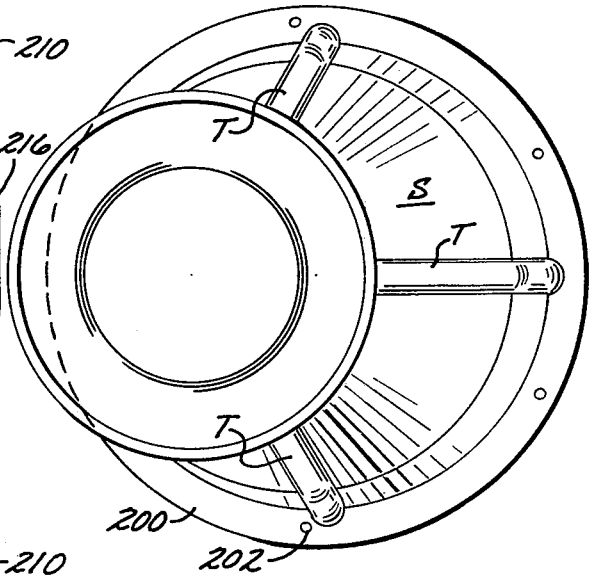
FIG. 13 is a top plan view of the fourth form of manhole structure.

The fourth form of manhole structure as may be seen in the drawings of FIGS. 12 and 13 included a flanged base section Q, one or more riser sections R that extend upwardly from the base section, a generally frusto-conical section S and a top section T, which sections are of circular transverse cross-section.

The fourth form of manhole structure P is adapted to be mounted on a foundation M of the structure shown in FIG. 1, which foundation has a number of spaced bolts 12 projecting upwardly from a flat ring-shaped surface 10 thereof. The base section Q includes a flat ring-shaped flange 200 that has a number of spaced holes 202 therein through which bolts 12 extend when the flange rests on surface 10. A cylindrical side wall 204 extends upwardly from the inner periphery of the flange 200. The side wall 204 a substantial distance above flange 200 develops into a circular outwardly extending lip 206, which lip has a cylindrical side wall extension 208 projecting upwardly from the outer periphery thereof.

Each of the riser sections R includes a cylindrical side wall 210 that has a lower end portion 212 and an upper portion that is defined by an outwardly projecting circular lip 214 that has a cylindrical side wall extension 216 projecting upwardly from the outer periphery thereof. The interior diameter of the side wall extension 208 and side wall extension 216 is less than the external diameters of the lower end portions 212, and as a result an annulus-shaped space 218 is defined therebetween as shown in FIG. 12. The annulus-shaped spaces 218 are filled with an epoxy cement 240 or the like that serves to bond the base section Q and risers R together as an intergral unit as shown in FIG. 12.

The generally frusto-conical section S that is illustrated in FIG. 15 as being off-centered includes a lower cylindrical side wall 220 of substantially the same external diameter as side wall 210. The lower cylindrical side wall 220 on the upper portion thereof develops into an upwardly extending off-centered frusto-conical shell 222 that on the upper portion thereof develops into an inwardly extending ring 224 as shown in FIG. 16 that has an upper cylindrical side wall 226 projecting upwardly from the inner periphery thereof. The ring 224 supports a heavy circular reinforcing bar 228 that is enveloped by a sheath 230 of fiberglass that is bonded to the external surface of shell 222 and merges into the bottom portion of side wall 226 as shown in FIG. 16.

Top T as shown in FIGS. 14 and 16 includes a cylindrical side wall section 232 that has an internal diameter greater than that of the external diameter of side wall 226 illustrated in FIG. 16 and cooperating therewith to define an annulus space 234 therebetween.

The top T has a ring-shaped flange 236 projecting outwardly from the upper edge thereof, and the flange on the outer periphery developing into an upwardly extending cylindrical side wall 238. A manhole assembly E may be disposed within side wall 238 to rest on flange 236, with the assembly having the upper surface thereof flush with the ground 68 or road surface. The height of the side wall 232 is adjusted by sawing or cutting a section from the lower portion thereof so that when the assembly E is placed therein the lower edge **232*a* of the side wall will be in abutting contact with the upper surface of ring-shaped portion 224 in the circular reinforcing bar 228 is disposed as shown in FIG. 16**.

The annulus space 234 as shown in FIG. 16 has a resilient sealing ring 250 disposed therein to prevent escape of gases through the annulus space. The top T preferably has circumferentially spaced reinforcing ribs 252 that extend downwardly from the bottom of flange 236 to the external surface of side wall 232. The portion **232*b* of side wall 232 that has been cut off so that the lower edge 232*a* will be in abutting contact with the ring-shaped portion 224 is shown in phantom line in FIG. 14**.

The fourth form P of the manhole structure is used in the same manner as previously described in conjunction with the other forms. Fourth form P of the manhole structure is illustrated in FIG. 12 as having a number of circumferentially spaced anti-buckling ribs R of generally transverse semi-circular cross-section molded into section Q, R and S and extending vertically thereon.

The adjacent ends of ribs T are in abutting contact as shown in FIG. 12. The manhole structures may be connected to existing sewer lines by extending the laterals through openings (not shown) formed in the riser sections R. To further protect each of the manhole structures previously described, each of the manhole structures after assembly on a foundation M has a continuous film T of a material that is inert to material flowing through the manhole structure, such as hydrogen sulphide, sewage, acids and the like. The film T is preferably one of the polymerized resins now commercially available.

The use and operation of the inventions, and the method of manufacture thereof has been explained previously in detail and need not be repeated.

What is claimed is:

1. In combination with a plurality of longitudinally spaced manhole foundations located at the bottom of a plurality of excavations, said manhole foundations each having a flat upper horizontal surface from which a plurality of circumferentially spaced stud bolts extends upwardly, said manhole foundations having passages formed therein that communicate with sloping sections of pipe that extend between said manhole foundations, a plurality of multi-piece prefabricated manhole components formed from a cured mixture of a polyester resin and fiberglass that are at least partially assembled in said excavations to define dimensionally stable manhole structures that rest on said foundations and extend upwardly therefrom to a traffic cover located at street grade, each of said manhole structures including:

a. a base component that includes a ring-shaped first flange that has an inner periphery and a plurality of circumferentially spaced openings therein through which said stud bolts extend when said first flange rests on said flat horizontal surface of one of said foundations, a cylindrical first wall that extends upwardly from said inner periphery to develop into a circular outwardly extending first body shoulder, and a second cylindrical wall that extends upwardly from a circular outer extremity of said body shoulder, said second cylindrical wall of substantially less height than said first cylindrical wall;

b. a top assembly component that removably supports said traffic cover and extends downwardly therefrom, said top assembly including a cylindrical wall member on the lower extremity thereof;

c. a riser component that includes a cylindrical shell that has an upper portion and a lower portion, said upper portion including an outwardly extending second body shoulder that has a cylindrical wall piece extending upwardly from the outer periphery thereof, said cylindrical wall member of said top resting on said second body shoulder and cooperating with said cylindrical wall piece to define a first annulus space therebetween and said lower portion of said riser resting on said first body shoulder and cooperating with said second cylindrical wall to define a second annulus space therebetween;

d. first resilient means in said first annulus space for removably effecting a seal between said cylindrical wall member of said top assembly and said cylindrical wall piece on said upper portion of said riser;

e. second means in said second annulus space for bonding and sealing said lower portion of said riser to said base;

f. third means for sealing said flange of said base to said horizontal surface of said foundation; and g. a plurality of nuts that engage said stud bolts to secure said flange of said base to said foundation.

2. A manhole structure as defined in claim 1 in which said manhole assembly is part of a sewer system, and said manhole assembly in addition including:

h. a continuous film of a polymerized resin that coats the interior surfaces of said top assembly, riser and base components, said polymerized resin being inert to gases emmanating from sewage flowing through said sewer system.

3. A manhole structure as defined in claim 1 in which said base, riser, and at least a part of said top assembly component have a plurality of circumferentially spaced, longitudinally extending anti-buckling ribs molded therein.

4. A manhole structure as defined in claim 1 which in addition includes:

h. a plurality of pairs of laterally spaced brackets secured to the interior surfaces of said top assembly and riser in substantially vertical alignment;

i. a pair of elongate vertically extending rigid members secured to said pairs of brackets; and j. a plurality of horizontal, vertically spaced rungs that extend between said pair of rigid members and cooperate therewith to provide a ladder for a workman to climb down into and out of said manhole for maintenance work.

5. A manhole structure as defined in claim 1 in which said top assembly component includes:

h. an upper top portion that includes a cylindrical wall that has an upper and lower end, a second ring-shaped flange that extends outwardly from said upper end, and a cylindrical rib that extends upwardly from the outer periphery of said second flange;

i. a lower top portion that includes said cylindrical wall member and from which cylindrical wall member an inwardly tapering wall extends upwardly to develop into a circular body shoulder that has a cylindrical lip projecting upwardly therefrom into said lower end of said cylindrical wall and defining an interior annulus space therewith, said lower end resting on said body shoulder;

j. third means in said interior annulus space for effecting a seal between said lower end of said cylindrical wall member of said lower top portion and said lip; and k. a circular concrete ring that extends around said cylindrical rib and upwardly therefrom to define a confined space in which said traffic cover may be removably disposed to rest on said cylindrical rib.

6. A manhole structure as defined in claim 5 which in addition includes:

l. a metallic reinforcing ring in said lower top portion that forms a part of said body shoulder therein.

7. In combination with a plurality of longitudinally spaced manhole foundations located at the bottom of a plurality of excavations, said manhole foundations each having a flat upper horizontal surface from which a plurality of circumferentially spaced stud bolts extend upwardly, said manhole foundations having passages formed therein that communicate with sloping sections of pipe that extend between said manhole foundations, a plurality of multi-piece prefabricated manhole components formed from a cured mixture of a polyester resin and fiberglass that are at least partially assembled in said excavations to define dimensionally stable manhole structures that rest on said foundations and extend upwardly therefrom to a traffic cover located at street grade, each of said manhole structures including:

a. a base component that includes a ring-shaped first flange that has an inner periphery and a plurality of circumferentially spaced openings therein through which said stud bolts extend when said first flange rests on said flat horizontal surface of one of said foundations, a cylindrical first wall that extends upwardly from said inner periphery to develop into a circular outwardly extending first body shoulder, and a second cylindrical wall that extends upwardly from a circular outer extremity of said body shoulder, said second cylindrical wall of substantially less height than said first cylindrcal wall;

b. a top assembly component that removably supports said traffic cover and extends downwardly therefrom, said top assembly including a cylindrical wall member on the lower extremity thereof;

c. a riser component that includes a cylindrical shell that has an upper portion and a lower portion, said lower portion extending downwardly into said second cylindrical wall to rest on said first body shoulder;

d. first means for sealing said lower portion to said second cylindrical side wall;

e. second means of circular transverse cross-section that extend upwardly from said upper portion to slightly less than the ground surface to support said traffic cover;

f. a concrete ring that is flush with street grade and extends around said top assembly component and cooperates therewith to define a confined space in which said traffic cover is removably disposed;

g. a plurality of pairs of laterally spaced brackets secured to the interior surface of said riser;

h. a pair of elongate vertically extending rigid members secured to said pairs of brackets; and i. a plurality of horizontal, vertically spaced rungs that extend between said pair of rigid members and cooperate therewith to provide a ladder for a workman to climb down into and out of said manhole for maintenance work.

8. The combination as defined in claim 7 which in addition includes a substantially horizontal flange that extends outwardly from said upper portion of said riser component, and said second means being;

j. a plurality of axially aligned vertically extending, horizontal first concrete rings stacked one above the other and in sealing abutting contact, with the lowermost of said concrete rings resting on said substantially horizontal rings;

k. a second concrete ring that encircles at least the uppermost one of said first rings and cooperates therewith to define a confined space in which said traffic cover is disposed to rest on the uppermost one of said first concrete rings, with the upper surfaces of said second concrete ring and said traffic cover substantially at said street grade.

9. The combination as defined in claim 7 in which said upper portion of said riser component includes an outwardly extending second body shoulder that has a cylindrical wall piece extending upwardly from the outer periphery thereof, and said second means including:

j. an upper top portion that includes a cylindrical wall that has an upper and lower end, a second ring-shaped flange that extends outwardly from said upper end, and a cylindrical rib that extends upwardly from the outer periphery of said second flange;

k. a lower top portion that includes said cylindrical wall member and from which cylindrical wall member an inwardly tapering wall extends upwardly to develop into a circular body shoulder that has a cylindrical lip projecting upwardly therefrom into said lower end of said cylindrical wall and defining an interior annulus space therewith, said lower end resting on said body shoulder;

l. third means in said interior annulus space for effecting a seal between said lower end of said cylindrical wall member of said lower top portion and said lip, with said concrete ring extending around said cylindrical rib and upwardly therefrom to define a confined space in which said traffic cover may be removably disposed to rest on said cylindrical rib.

10. The combination as defined in claim 9 in which the vertical centerline of said upper top portion is laterally offset from the vertical centerline of said riser.

11. The combination as defined in claim 9 in which said upper and lower top portions and said riser component are vertically aligned.

12. The combination as defined in claim 9 which in addition includes:

m. a metallic reinforcing ring in said lower top portion that forms a part of said body shoulder therein.

13. The combination as defined in claim 12 in which said reinforcing ring is enveloped in the material defining said lower top portion.

14. The combination as defined in claim 9 which in addition includes:

m. a continuous film of an inert material that coats the interior surfaces of said riser and upper and lower top portions.

15. The combination as defined in claimed 14 in which said base, riser and upper and lower top portions are integrally joined together prior to being delivered to the job site.

16. The combination as defined in claim 9 in which said upper top portion is removably sealed to said lower top portion.

17. The combination as defined in claim 9 which in addition includes:

m. a resilient ring that removably seals said upper portion of said top to said lower portion thereof.

* * * * *